United States Patent [19]

Weber et al.

[11] Patent Number: 4,743,199

[45] Date of Patent: May 10, 1988

[54] METHOD AND TOOTH BRUSH FOR THE REMOVAL OF PLAQUE FROM TEETH AND GUMS

[76] Inventors: Anette Weber; Hans G. Weber, both of Topferplatz 7, 4350 Recklinghausen, Fed. Rep. of Germany

[21] Appl. No.: 809,519

[22] Filed: Dec. 16, 1985

[30] Foreign Application Priority Data

Dec. 19, 1984 [DE] Fed. Rep. of Germany ..... 3446272

[51] Int. Cl.[4] ..... A61K 5/00

[52] U.S. Cl. ..... 433/216; 433/80; 128/62 A

[58] Field of Search ..... 433/215, 216, 217, 80, 433/81, 82, 88; 128/62 A, 66

[56] References Cited

U.S. PATENT DOCUMENTS

| | | | |
|---|---|---|---|
| 1,693,248 | 11/1928 | Newton | 128/62 A |
| 2,081,792 | 5/1937 | Cassanos et al. | 128/62 A |
| 3,593,707 | 7/1971 | Pifer | 128/62 A |
| 4,422,450 | 12/1983 | Rusteberg | 128/62 A |

FOREIGN PATENT DOCUMENTS

| | | |
|---|---|---|
| 687746 | 2/1940 | Fed. Rep. of Germany . |
| 1966222 | 2/1967 | Fed. Rep. of Germany . |
| 2230177 | 1/1974 | Fed. Rep. of Germany . |
| 2721699 | 12/1977 | Fed. Rep. of Germany . |
| 3138938 | 4/1983 | Fed. Rep. of Germany . |

*Primary Examiner*—John J. Wilson
*Assistant Examiner*—Adriene Lepiane
*Attorney, Agent, or Firm*—Michael J. Striker

[57] ABSTRACT

In a method and a tooth brush for removing plaque from teeth and gums, the mixture of ozone with air of a predetermined ozone concentration is fed into the oral cavity through tubular bristles, provided on the surface of the tooth brush, from a source of the ozone-air mixture. The ozone-air mixture is distributed simultaneously with a dentifrice containing solid particles through which undesired high ozone concentration at spots outside a target spot in the oral cavity is neutralized.

1 Claim, 2 Drawing Sheets

METHOD AND TOOTH BRUSH FOR THE REMOVAL OF PLAQUE FROM TEETH AND GUMS

BACKGROUND OF THE INVENTION

The present invention relates to a method for the removal of plaque from teeth and gums and a tooth brush for carrying out the method.

The methods and tooth brushes of the type under discussion have been known. Such a tooth brush has been disclosed, for example in DE-PS No. 87 605 of 1895. Openings have been provided in the bristle receiving surface of the tooth brush between the bristles, which openings have been in communication with a passage formed in the hand grip of the brush and, through a coupling connected to the end of that grip, with a flexible hose. The opposite end of the hose has been connected with a liquid-containing rubber vessel from which liquid could be pressed by hand pressure through the hose and the openings between the bristles and applied to the teeth surfaces.

A further method as well, as a tooth brush for carrying out the same, has been described in DE-GM 1, 966, 222. This method as well as the device therefore are distinguished from the above-described method and tooth brush in that the end of the hose connected to the tooth brush can be connected by a short tube with the interior of a spray bottle which is connectable by a further hose and a longer immersion tube with a device for generating pressurized air, which device is actuated by and connectable to the network by means of an electric wire.

Further conventional methods and tooth brushes have been known, which have been provided with customary water valves and were actuated by water pressure. Such tooth brushes have been disclosed in DE-PS 687, 746; DE-OS 2, 230, 177; DE-OS 27 21 699 and DE-OS 31 38 938.

In all above-mentioned conventional methods, the opening provided in the bristle-receiving surface of the tooth brush do not extend beyond that surface whereby a satisfactory spraying effect through the bristles is prevented or limited to a minimum so that an undesired mechanical irritation is exerted due to high pressure at inflammable spots in the oral cavity. Furthermore all those methods have in common that the tooth brushes are supplied during operation with liquid, preferably with water which, on the one hand, exerts a relatively high pressure, and, on the other hand, causes generation of new plaque on the teeth and gums. And finally, the liquid very often does not reach or insufficiently contacts a target spot because the distance between the outlet opening for the liquid and the target spot, for example a tooth stem, must be overlapped by the length of the bristles.

SUMMARY OF THE INVENTION

It is an object of the present invention to provide an improved method and a tooth brush for removing plaque from teeth and gums.

It is another object of the invention to provide a method and a tooth brush for removing plaque, which would be effective even at inflammable surfaces in the oral cavity, in case of paradontosis or similar infections.

These and other objects of the present invention are attained by a method for the removal of plague from teeth and gums in the oral cavity, comprising supplying bristles of a tooth brush during cleaning of teeth with an ozone-air mixture fed through said bristles into the oral cavity. Due to the method of this invention during the cleaning of teeth with a customary cleaning agent simultaneously the ozone-air mixture is supplied into the oral cavity, which mixture because of its gaseous state can reach any area at any angle in the oral cavity so that plaque formed therein would be destroyed. It is known that ozone is a good desinfecting agent which kills germs and fungus and leads to nourishing of the mucous membrane.

Dr. Fisch from Zurich utilized ozone for the first time in 1934 in dental medicine for destroying plaque in cases of paradontosis and inflammations. Ozone is used at the present time in the form of ozone-spray which is applied as a mouth shower and can, however, cause a mechanical irritation and also can lead due to a sudden expansion with or without propellent gas to a shock-like cooling of the tooth area. Furthermore there has been a danger of shifting of the mucous membrane towards the eyes.

The ozone-air mixture may have ozone concentration of at most 0.2 mg per $ml^3$ of air, which is a physiologically acceptable concentration.

The ozone-air mixture may have the ozone concentration of more than 0.2 mg per $ml^3$ of air and be distributed in the oral cavity simultaneously with a dentifrice having solid particles through which undesired high ozone concentration at spots outside a target spot in the oral cavity are neutralized. Due to enhanced ozone concentration at a target spot a rigorous destruction of plaque is ensured while at other spots in the oral cavity the action of such highly concentrated mixture would be neutralized.

The ozone-air mixture may be rubbed in and massaged immediately through the bristles at a target spot in the oral cavity; said target spot may be a tooth stem or a tooth gum. Thereby a shorter path of the ozone-air mixture to the tooth stem or gum is provided to ensure an effective removal of plague therefrom.

The objects of the invention are further attained by a tooth brush for the removal of plaque from teeth and gums in the oral cavity by supplying an ozone-air mixture through the brush int the oral cavity during cleaning, comprising a hand grip having a bristle portion and an end opposite to said bristle portion, said bristle portion having a bristle receiving surface with cleaning bristles thereon; a coupling provided at said end; a flexible hose connectable to said coupling, said surface having openings; and flexible tubular bristles received in said openings and provided with outlet openings, said tubular bristles being in communication with said hose for supplying said mixture thereto and projecting outwardly beyond said surface.

The length of the tubular bristles may be at least $\frac{1}{4}$ of the length of the cleaning bristles.

The tubular bristles may also have the same length with the cleaning bristles.

Each tubular bristle may have a narrowing end formed with a nozzle-like outlet opening, whereby the ozone-air mixture is applied to the teeth or gums with a desired high speed.

Additionally to the end outlet opening or in place thereof lateral outlet openings can be provided in each tubular bristle. Thus immediate rubbing effect can be obtained by means of the tubular bristles and the cleaning bristles at the outer surfaces of teeth and in the region of the mucous membrane, and a directed discharge of the ozone-air mixture would be ensured.

The tubular bristles may be uniformly distributed over said surface and be made of ozone-resistant synthetic plastic material.

The coupling may have a plurality of bypass connections gas-tightly connected thereto so that, in addition to the ozone-air mixture, any other agent, for example a fluidic anti-infection agent, can be fed into the mouth during cleaning.

The tooth brush may further include an ozonizer which is connectable to said coupling by said hose, said hose being made of plastics.

A check valve, which is self-closing in the direction of said ozonizer, may be installed between the coupling and the hose and/or at the outlet of the ozonizer so as to preclude penetration of the dentifrice into the hose and/or ozonizer.

The ozonizer may include a Liebig condenser with a transformer and a mixture pump, a housing accommodating said condenser and said pump and having an air inlet and an ozone-air mixture outlet, and a connection to a 220/110 volt network, said hose being releasably connectable to said outlet.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DETAILED DESCRIPTION OF THE PREFERRED EMBODIMENTS

Figure 1:
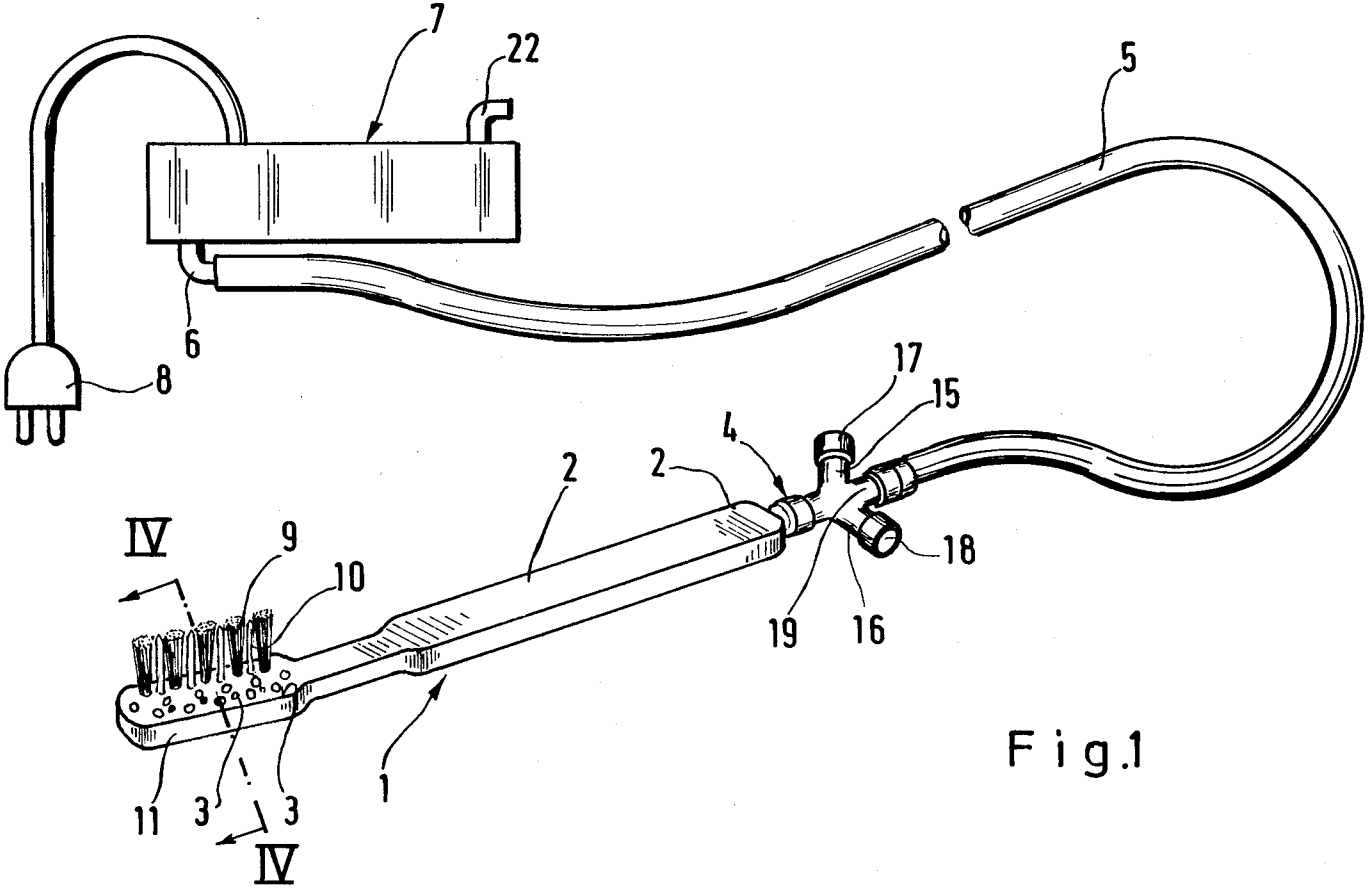
FIG. 1 is a perspective view of the tooth brush in conjunction with an ozonizer, according to the invention.

Referring now to the drawings in detail, and firstly to FIG. 1, it will be seen that a tooth brush 1 according to the invention includes a hand grip 2 terminated with a bristle portion 11 which has a bristle field or surface 3, and a coupling 4 for connecting a flexible ozone resistant hose 5, leading to an ozonizer 7 with the end of the hand grip 2.

The end of the flexible hose 5 made of synthetic plastic material is joined with an ozone-air-mixture connection 6 of the ozonizer 7. The latter includes non-illustrated transformer and mixture pump in the known fashion, which are connectable by means of a plug 8 and a switch-over connection to 220/110 volt network.

Figure 3:
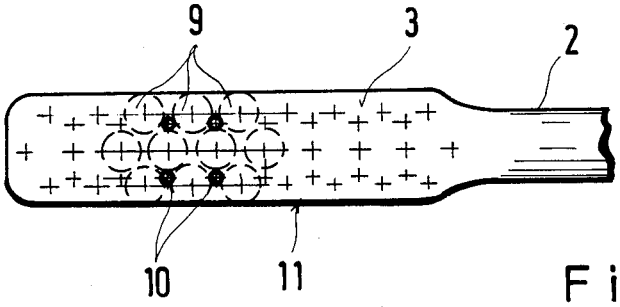
FIG. 3 is a top plan view of the bristle surface of the tooth brush of FIG. 1, on enlarged scale.
Figure 4:
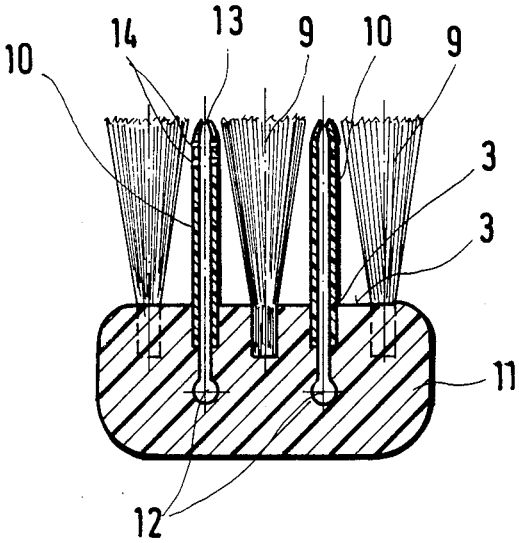
FIG. 4 is a sectional view taken along line IV—IV of FIG. 1.

With reference to FIGS. 3 and 4 it will be seen that cleaning bristles 9 as well as tubular bristles or tubes 10 extend outwardly from the bristle receiving surface 3. Tubes 10 as shown in FIG. 3 are uniformly distributed over the surface 3 and are located in interstices between the bristles 9. Tubes 10 are made of synthetic plastic material resistant to ozone. Tubes 10 are advantageously inserted at their ends in the bristle portion 11 of the tooth brush and are each in connection with the flexible hose 5 through at least one passage 12 formed in the bristle portion 11 and extended through the grip 2, and the coupling 4 provided at the end 2' of the grip.

Each tubular bristle or tube 10 has an outlet 13, at which it narrows to form a nozzle, and/or a plurality of lateral outlet openings 14 as shown on the left-hand tube 10 in FIG. 4. All tubular bristles 10 are similarly to bristles 9 flexible and do not make the area of the oral cavity very sensitive to them. Coupling 4 is in the exemplified embodiment provided with two bypass connections 15, 16 which are gas-tightly connectable to the coupling by small caps 17, 18 threadable thereto. Thereby bypass connections 15, 16 can be admitted in addition to the ozone-air mixture with a further material, for example liquid cleaning or disinfecting agent which is fed together with the ozone-air mixture into the mouth.

In order to prevent penetration of fluidic tooth-cleaning agent into the flexible plastic hose and/or into the ozonizer 7, either coupling 4 has at the connection 19 a check valve or the ozone air mixture outlet 6 of the ozonizer 7 has a similar check valve. Such a check valve is not shown but is a conventional valve self-closing in the direction of the ozonizer 7.

Figure 2:
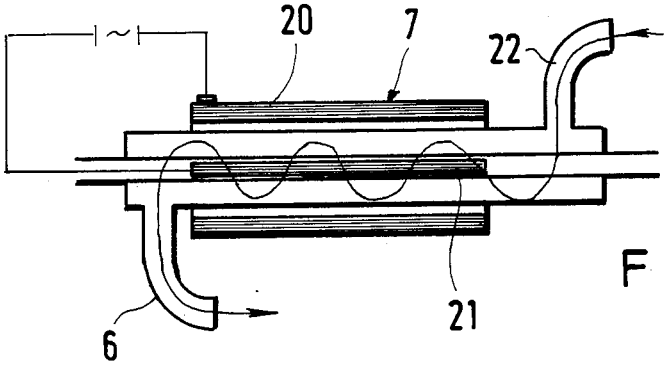
FIG. 2 is a schematic view of the ozonizer of FIG. 1.

FIG. 2 schematically illustrates the ozonizer 7 in section. The ozonizer is substantially comprised of two concentrically arranged potential surfaces 20 and 21 between which a high voltage field of about 5, 000 volt is available. An air inlet 22 is provided in the ozonizer through which air is sucked and pressed through the high voltage field whereby an ozone-air mixture can be discharged from the outlet 6 because air in any rate contains only about 20% of oxygen. If pure oxygen is admitted at the inlet 22 the ozone-air mixture with 15% of ozone can be produced at the high voltage field between potentials 20 and 21. The high voltage field of about 5, 000 volt is generated between potentials 20 and 21 at the secondary side of the non-illustrated transformer which has switchable network voltage of 220/110 volt at the primary side. The above-described ozonizer is basically known and does not itself represent the invention.

The method of the removal of plaque from the oral cavity according to the present invention is as follows:

After connecting the ozonizer 7 by plug 8 to the network the tooth brush 1, covered or non-covered with an antifrice agent, is inserted into a mouth with its bristle portion 11 and cleaning or massaging movements are imparted to the bristles in the usual fashion at certain places, for example at tooth stems and/or gums. Due to flexibility of the tubular bristles 10 they, as well as bristles 9, independently adjust to and pass unevennesses in the oral cavity. Thereby upon deflection of the tubular bristles the ozone-air mixture is discharged therefrom through the lateral outlet openings 14 in a desired manner onto the spots in the mouth, with which they are in contact, without requiring the provision of a predetermined transporting path as known in the prior art. Due to the direct transport of the ozone-air mixture to the target spot in connection with an intensive rubbing-in and massaging effect, an extremely effective destruction of plaque directly at that spot is obtained.

With the highest concentration of the ozone-air mixture over 0.2 mg/per $ml^3$ of air dentifrice with solid particles can be simultaneously fed into and distributed in the oral cavity so that undesired high ozone concentration at other spots in the oral cavity would be neutralized. In this case bristles 9 cause with the applied neutralizing solid particles a screening effect which allows a higher ozone-air mixture concentration at the spot being treated.

It will be understood that each of the elements describe above, or two or more together, may also find a useful application in other types of methods for the removal of plaque from the oral cavity and tooth brushes therefore differing from the types described above.

While the invention has been illustrated and described as embodied in a method for the removal of plaque from the oral cacity and a tooth brush therefor, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A method for the removal of plaque from teeth and gums in the oral cavity, comprising supplying bristles of a tooth brush during cleaning of teeth with an ozone-air mixture fed by said bristles into the oral cavity, the ozone-air mixuture being rubbed in and massaged immediately through the bristles at a target spot in the oral cavity, said target spot being a tooth stem or a tooth gum, wherein said ozone-air mixture has ozone-concentration of more than 0.2 mg per $lm^3$ of air and is distributed in the oral cavity simultaneously with a dentifrice having solid particles through which undesired high ozone concentration at spots outside a target spot in the oral cavity is neutralized.

* * * * *